US007303493B1

(12) United States Patent
Ehresman

(10) Patent No.: US 7,303,493 B1
(45) Date of Patent: Dec. 4, 2007

(54) GOLF TEE SUPPORT

(76) Inventor: Dennis D. Ehresman, 25470 Chippendale, Roseville, MI (US) 48066

( * ) Notice: Subject to any disclaimer, the term of this patent is extended or adjusted under 35 U.S.C. 154(b) by 78 days.

(21) Appl. No.: 11/247,639

(22) Filed: Oct. 11, 2005

(51) Int. Cl.
*A63B 69/36* (2006.01)

(52) U.S. Cl. ..... 473/386

(58) Field of Classification Search ..... 473/278, 473/386; 206/338, 443, 423, 214; 47/41.13; 211/60.1, 70.7; 30/329
See application file for complete search history.

(56) References Cited

U.S. PATENT DOCUMENTS

| | | | | |
|---|---|---|---|---|
| 768,423 | A * | 8/1904 | Cliff | 206/338 |
| 1,431,679 | A | 10/1922 | Noda | |
| 3,093,145 | A * | 6/1963 | Yamada | 131/235.1 |
| 3,477,175 | A * | 11/1969 | Sakamoto | 47/41.13 |
| 3,516,664 | A | 6/1970 | Brennan | |
| 3,906,666 | A * | 9/1975 | Daenen et al. | 47/41.13 |
| 5,052,689 | A * | 10/1991 | Lettrich | 473/257 |
| 5,156,403 | A | 10/1992 | Martino | |
| 5,766,100 | A | 6/1998 | Dilmore | |
| 6,062,989 | A | 5/2000 | Wagner et al. | |
| 6,082,559 | A * | 7/2000 | Levsen | 211/70.7 |
| 6,139,443 | A | 10/2000 | Reynolds | |
| 6,383,094 | B1 | 5/2002 | Reynolds | |
| 6,482,111 | B1 | 11/2002 | Jofferion | |

* cited by examiner

*Primary Examiner*—Raleigh W. Chiu
(74) *Attorney, Agent, or Firm*—Young Basile Hanlon McFarlane & Helmholdt PC.

(57) ABSTRACT

A golf tee support includes a base having a planar configuration for positioning on the ground, and a cylindrical body having an integral floor with an opposing open end providing an access to a cavity therein. The cylindrical body is secured to the base. A plurality of rigid fingers made of durable plastic or rubber have one end secured to the floor so that the fingers are orientated parallel to the cylindrical body for receiving a golf tee portion and holding the golf tee portion in a vertical orientation. The rigid fingers have opposing ends terminating at the top edge of the cylindrical body. The opposing ends are tapered for facilitating the entry of the golf tee into the cavity. The plurality of rigid fingers are packed in the cylindrical body to occupy at least 75-90% of the volume of the cavity, but allowing each rigid finger to be spaced from an adjacent rigid finger.

17 Claims, 2 Drawing Sheets

GOLF TEE SUPPORT

FIELD OF THE INVENTION

The invention relates to a golf tee support.

BACKGROUND OF THE INVENTION

Golf tees are commonly used at driving ranges and golf courses to position the golf ball above the ground to simulate conditions of a natural golf course. The typical golf tee at a driving range has a generally cylindrical body set at a predetermined height for anchoring a golf ball. The golfer is forced to use that predetermined height when hitting the golf balls from the tee. Generally, golfers tee their golf balls higher for drivers and lower for iron club. In the golf tee assembly of the prior art, the location of the ball relative to the ground cannot be raised or lowered at the golfer's discretion. The golf tee assemblies of the prior art do not allow for these variances in height.

SUMMARY OF THE INVENTION

It is the intent of the present invention to address the aforementioned concern. According to one aspect of the invention, a golf tee support is provided having a body formed by a floor and a vertical wall having a cavity formed therein. A plurality of fingers are carried within the cavity. The fingers have rigid elongate shapes with exposed ends tapered to a point, similar to a round toothpick. The fingers are arranged parallel to the vertical walls.

In another aspect of the invention, the rigid fingers are made of durable plastic or rubber for receiving a tee portion and holding the tee portion in a vertical orientation.

In yet another aspect of the invention, the rigid fingers are tapered at one end for urging the plurality of rigid fingers inwardly for engaging the tee portion more securely.

In yet another aspect of the invention, the golf tee support has a base having a planar surface wherein the base is secured to the floor of the body.

In yet another aspect of the invention, the base and the body are molded as a single integral unit.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
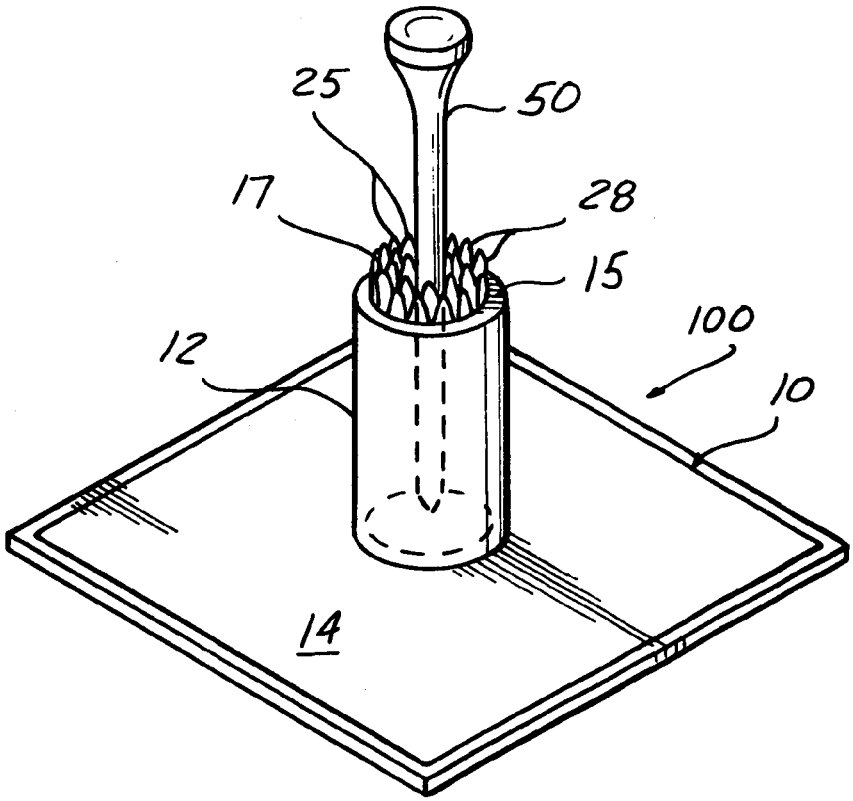
FIG. 1 is a perspective view of a golf tee support assembly according to the present invention showing a golf tee disposed therein.
Figure 2:
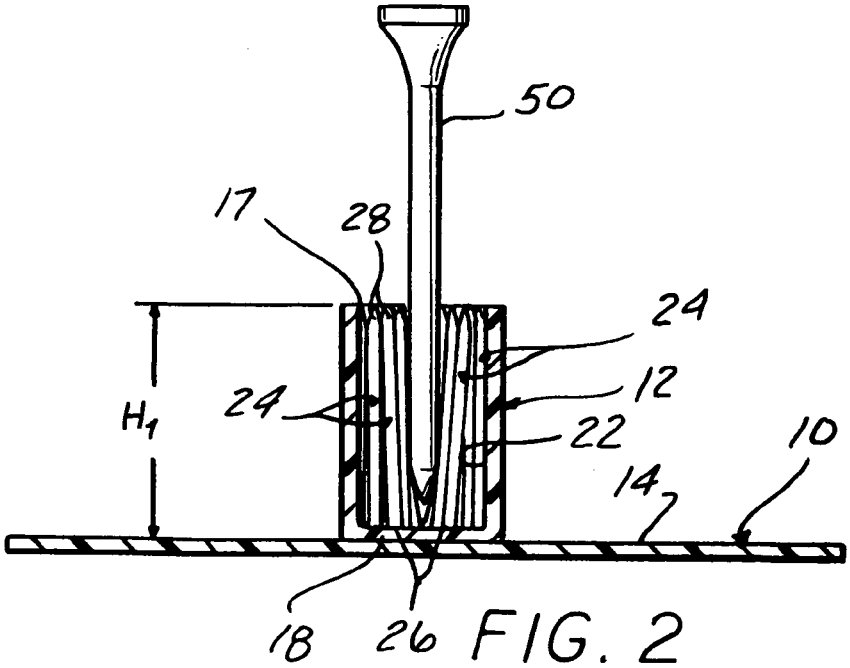
FIG. 2 is a side sectional view of a second aspect of the golf tee support assembly with a golf tee disposed therein.

Referring to FIGS. 1 and 2, the golf tee support assembly 100 includes a mat 10 which has a flat planar configuration for placement on level ground. The mat 10 may be any shape, but by way of example and not limitation is illustrated as rectangular in FIGS. 1 and 2. The mat 10 is preferably made from an elastomeric material to provide durability and weather-resistance. In the preferred embodiment, the mat 10 is approximately 3.5 inches square and ⅛ inch thick. The size of the golf tee support assembly 100 permits storage of the support 100 in a golf bag. A body 12 is secured to the upper surface 14 of the mat 10. In the illustrated aspect, the body 12 has a tubular, vertically arranged wall 16 integrally formed with a floor 18. The vertical wall 16 may be cylindrical as shown in FIG. 1 or any polygonal shape. The body 12 has an aperture 17 in its top rim 15, opening to an interior cavity 22. The aperture 17 is provided for positioning a golf tee 50 therein or placing a golf ball thereon.

The floor 18 can be connected to the mat 10 by means of sonic or heat welding 20. As an alternative option, the body 12 and mat 10 can be integrally formed in a single molding process so that the floor 18 is on the same plane as the mat 10.

Figure 3:
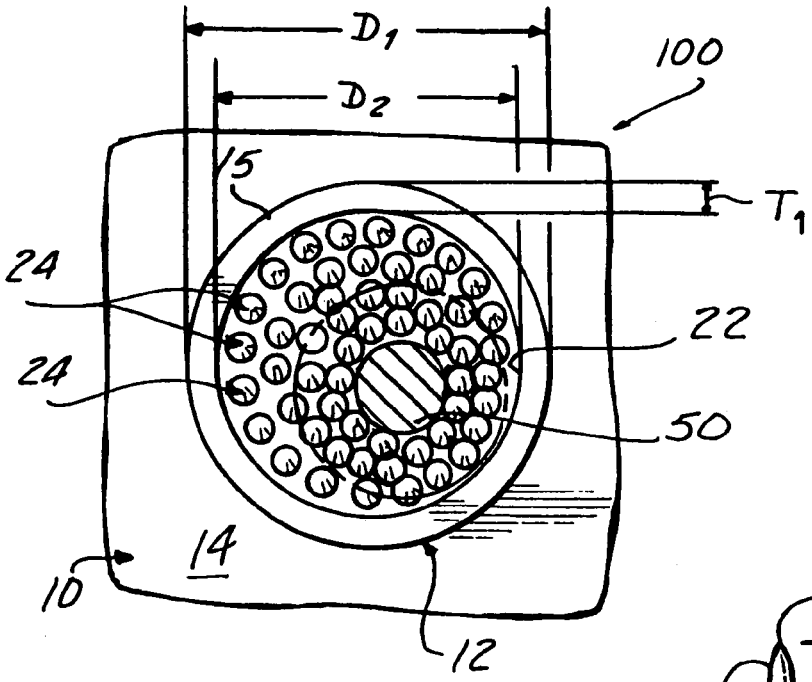
FIG. 3 is a partial top planar view of a portion of the golf tee support assembly showing the golf tee in cross section.

Referring to FIGS. 2 and 3, by way of example and not a limitation, the body 12 has an outer diameter ($D_1$) of ⅝ inch The interior cavity 22 has a diameter ($D_2$) essentially ½ inch. The height ($H_1$) of the wall 16 of the body 12 is essentially 1.0 inch. The wall 16 of the body 12 has a thickness ($T_1$) of approximately 1/16 inch.

The cavity 22 of the body 12 is filled with a plurality of fingers 24. Each finger 24 has a first end 26 secured to the floor 18 of the body 12. The first ends 26 of the fingers 24 may be sonic or heat welded to the floor 18, or, as an alternative, be integrally molded to the floor 18 of the body member 12.

The opposing end 28 of the fingers 24 terminates slightly above the rim 15 of the body 12, as shown in FIG. 1, or flush with the rim 15 as shown in FIG. 2, or slightly below the rim 15 (not shown). The fingers 24 are individual rubber or plastic elongate members tapering to a point, similar in shape to a round toothpick. The fingers 24 are rigid so that the fingers 24 maintain a vertical position in the cavity when undisturbed.

Figure 4:
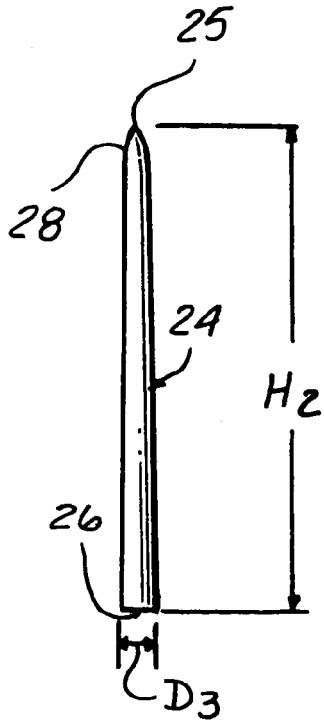
FIG. 4 is a side elevational view of one of the fingers of the golf tee support assembly.

Referring to FIG. 4, the fingers 24 have a diameter ($D_3$) of essentially 1/16 inch over most of the axial length of the finger 24. The exposed or upper end 28 of each finger 24 can be tapered to a point 25 to facilitate entry of a golf tee 50 therebetween. Each finger 24 has a height ($H_2$) of essentially 1 inch±1/16 inch. The height of the fingers 24 in the first aspect, shown in FIG. 1 is essentially 1 1/16 so that only 1/16 inch of each finger 24 is exposed above the rim 15. The height of the fingers 24 in the second aspect, shown in FIG. 2 is essentially 1.0 inch, the same height of the body 12, so that the points 25 of the fingers 25 are flush (having surfaces in the same plane) with the rim 15. In each of the aspects, all of the fingers 24 within an interior cavity 22 of a body 12 are preferably the same height.

The number of fingers 24 contained in a cavity of the body 12 is such that the plurality of fingers 24 encompass 75-90% of the volume of the cavity 22 for holding a golf tee 50 in an upright position. Each finger 24 is normally spaced from any other adjacent finger 24 within the cavity 22 to allow for the insertion of a golf tee 50 and further to allow for sideways movement.

When a golf tee 50 is inserted into the cavity 22, the disturbed fingers 24 are displaced by the golf tee 50 so that the disturbed fingers 24 are slightly tilted over into adjacent fingers 24 as shown in FIGS. 2 and 3. The rigidity of the fingers 24 holds the golf tee 50 in an upright position. When the golf tee 50 is removed, the fingers 24 have a resiliency to reclaim their upright vertical orientation.

As seen in FIG. 3, another advantage of the golf tee support 100 according to the present invention is that it is not necessary to insert the golf tee 50 in a central location of the golf tee support 100 as in previous assemblies. The golfer can place his tee 50 anywhere within the surface area of the cavity 22. This saves time between shots for the golfer. The rigidity of the fingers 24 also allows the golfer to adjust the height of his tee 50 at numerous levels by simply pushing his tee 50 into the cavity 22 until the golf tee is at the desired height. The plurality of fingers 24 holds the golf tee 50 in the upright position at any height where there is sufficient surface contact with the tee 50. Alternately, the golfer can merely place his golf ball directly on the fingers 24, especially in the embodiment (FIG. 1) where the fingers 24 are exposed above the rim 15. When the golf ball is positioned directly on the fingers 24, the golfer can then simulate the rough or fairway shots. This allows the golfer to practice with various golf clubs without moving to another site.

The golf tee support 100 has been described as a tubular body 12 connected to a mat 10 so that the golfer can transport the golf tee support 100 to various driving ranges or even to the golfer's property. However, it is perceived that owners of the driving ranges will want to retrofit their existing tee supports with the golf tee support 100 of the present invention. Therefore, a retrofit golf tee support 200 is provided which includes the tubular body 112 and the plurality of fingers 124 disposed therein as described, supra.

Figure 5:
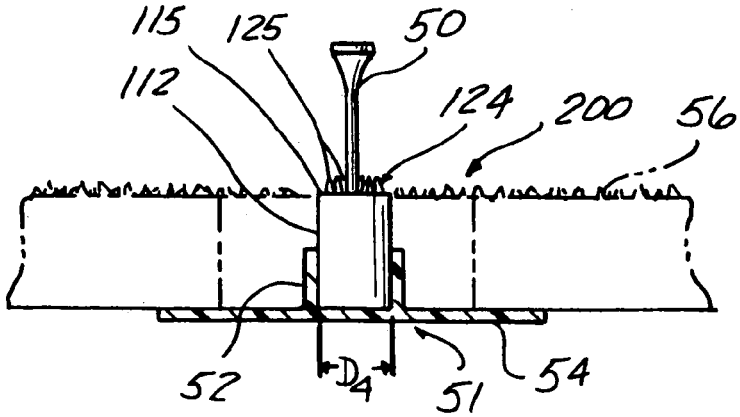
FIG. 5 is a side elevational view of a third aspect of the golf tee support assembly of the invention.

Referring to FIG. 5, existing tee supports 51 generally include a exterior tube 52 connected to a mat 54. The mat 54 is usually positioned beneath artificial turf 56. The method for retrofitting an existing tee support 51 includes sizing the existing exterior tube 52 to a height less than the height ($H_1$) of the body 12. Sizing the exterior tube 52 may require cutting the tube 52 to a height which extends below or flush with the adjacent artificial turf 56. The exterior diameter $D_1$ of the retrofit body 112 is slightly smaller than the inner diameter ($D_4$) of the exterior tube 52 so that the retrofit tee support 200 can fit snugly within the exterior tube 52.

The height of ($H_1$) of the body 112 remains essential at 1.0 inch, but can be reduced or enlarged so that the points 125 of the fingers 124 terminate at essentially the same height as the artificial turf 56. Preferably, the points 125 of the fingers 124 are exposed beyond the rim 115 of the body 112. This retrofit allows owners of driving ranges to easily and economically update their golf tee supports.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A golf tee support comprising:

a body having a floor, a vertical wall, and an opening at a top of the body accessing a cavity formed therein;

a mat having a planar surface, said planar surface having an area larger than the area of the floor of the body, wherein the mat is secured to a bottom surface of the floor; and a plurality of tiltable fingers carried within the cavity and directly attached to the floor, said fingers normally arranged parallel to the vertical wall wherein the fingers have a narrow elongate shape and are made of a rigid and resilient material for receiving a golf tee therebetween and holding said tee in a vertical orientation by said fingers slightly tilting into adjacent fingers and for allowing the fingers to return to an upright position when the tee is removed.

2. The golf tee support of claim 1, wherein the fingers are made of one of plastic and rubber.

3. The golf tee support of claim 1, wherein the fingers have a height terminating at a top edge of the vertical wall.

4. The golf tee support of claim 1, wherein the wall has a top edge defining the upper periphery of the body wherein the upper periphery of the body is parallel to the floor and the fingers have a height terminating above the top edge of the vertical wall.

5. The golf tee support of claim 4, wherein the fingers have tapered second ends for facilitating the entry of the golf tee into the cavity.

6. The golf tee support of claim 1, wherein the fingers each have a first end and a second end, said first end secured to the floor of the body.

7. The golf tee support of claim 1, wherein the body and plurality of fingers are molded as a single integral unit.

8. The golf tee support of claim 1, wherein the plurality of fingers are connected to the floor of the body by one of sonic and heat welding.

9. The golf tee support of claim 8, wherein the mat is secured to the body by one of sonic and heat welding.

10. The golf tee support of claim 1, wherein the mat and body are molded as a single integral unit.

11. The golf tee support of claim 1, wherein each finger is spaced from another adjacent finger in the cavity.

12. The golf tee support of claim 11 wherein the plurality of fingers encompass 75-90% of the volume of the cavity for holding the golf tee in an upright position.

13. The golf tee support of claim 1, wherein the body is tubular and has a height essentially 1.0 inch.

14. The golf tee support of claim 13 wherein each finger has a height of essentially 1.0 inch±1/16 inch.

15. A method for retrofitting an existing golf tee support having a mat and exterior tubular member comprising the steps of:

installing a body with a floor and a plurality of fingers extending from the floor into the existing exterior tubular member; and sizing the exterior tubular member to a height less than the height of the body.

16. The method of claim 15 wherein the step of sizing the exterior tubular member includes the step of cutting a portion of the height from the exterior tubular member.

17. The method of claim 16, wherein the step of cutting includes the step of cutting the exterior tubular member to a height less than the height of adjacent artificial turf.

* * * * *